US007814597B2

(12) United States Patent
Fife et al.

(10) Patent No.: US 7,814,597 B2
(45) Date of Patent: Oct. 19, 2010

(54) METHOD AND APPARATUS FOR DETERMINING CLOTH AND FLUID MOTION IN A WASHING MACHINE

(75) Inventors: John Michael Fife, Menlo Park, CA (US); Joseph F. Rakow, San Francisco, CA (US); Alan H. Starkie, Los Gatos, CA (US)

(73) Assignee: Whirlpool Corporation, Benton Harbor, MI (US)

( * ) Notice: Subject to any disclaimer, the term of this patent is extended or adjusted under 35 U.S.C. 154(b) by 523 days.

(21) Appl. No.: 11/780,087

(22) Filed: Jul. 19, 2007

(65) Prior Publication Data

US 2008/0017221 A1 Jan. 24, 2008

Related U.S. Application Data

(60) Provisional application No. 60/807,949, filed on Jul. 21, 2006.

(51) Int. Cl.
*D06F 39/00* (2006.01)

(52) U.S. Cl. ..... 8/159; 68/12.01; 68/12.02; 68/212

(58) Field of Classification Search ..... 8/158, 8/159; 68/12.01, 12.02, 212
See application file for complete search history.

(56) References Cited

U.S. PATENT DOCUMENTS

| | | | | |
|---|---|---|---|---|
| 6,212,722 | B1 * | 4/2001 | Pinkowski et al. | 8/158 |
| 2004/0139556 | A1 * | 7/2004 | Lee et al. | 8/158 |
| 2005/0016225 | A1 * | 1/2005 | Poehler | 68/12.02 |

* cited by examiner

*Primary Examiner*—Michael Barr
*Assistant Examiner*—David Cormier
(74) *Attorney, Agent, or Firm*—Clifton G. Green; McGarry Bair P.C.

(57) ABSTRACT

A method and apparatus for measuring and recording conditions inside a chamber containing cloth items and fluid is provided. The method involves placement of contact sensors inside a wash chamber that can detect contact with a target cloth. The method also involves placement of rotation sensors for determining the position of rotating components within the washer. The method also involves installation of friction sensors that can measure forces between cloth items and the surfaces of the wash chamber. The method also involves installation of a fluid flow sensing system to determine the direction of fluid flow in the washer. All or some of the aforementioned signals are communicated from instruments within the washer to an external computer and may be converted to spatial locations for the impeller, target cloth and basket. Video may be recorded and combined with the sensor data to develop a more complete picture of cloth motion.

15 Claims, 6 Drawing Sheets

METHOD AND APPARATUS FOR DETERMINING CLOTH AND FLUID MOTION IN A WASHING MACHINE

CROSS-REFERENCE TO RELATED APPLICATION

This application claims the benefit of U.S. provisional application Ser. No. 60/807,949, filed Jul. 21, 2006, which is incorporated herein in its entirety.

BACKGROUND OF THE INVENTION

1. Field of the Invention

The present invention is directed at measuring and recording the conditions inside a chamber containing a mixture of cloth items and fluid. The invention has particular utility in characterizing the motion of cloth items in an automatic washing machine, and providing information to help understand the mechanisms at work driving that motion.

2. Description of the Related Art

In the field of clothes washing machine technology, new machines are being designed to increase electrical efficiency, reduce water consumption, and improve cleaning effectiveness. These improvements require a significant departure from current technology, and considerable effort is underway to design new machines.

In the washing machine design process, reliable measurement and observation of the conditions inside the wash chamber provide important information about the effect of various configurations, features, operational parameters, and settings of the washing machine. This information may allow the designer to use a closed-loop iterative approach in which design changes are based on reliable measured and observed effects.

In many washing machine design environments, direct visual observation is used, along with some basic measurement of fluid flows, rotational speed, power, timing, and cleaning performance. However, there is currently no method in widespread use to accurately measure the circulation of cloth items and fluids and driving forces of cloth items and fluid in an automatic washing machine. Although some methods to measure the circulation and driving forces exist, the known methods provide limited information, disturb the operation of the machine, or otherwise modify the parameters it is desired to measure. A method and apparatus that could measure the circulation and driving forces without significantly disturbing the operation would be a valuable complementary tool in the design process because it would provide more information to the designer about the nature of the physical processes taking place in the wash chamber.

SUMMARY OF THE INVENTION

The present invention addresses the foregoing needs by providing a method by which the driving forces and consequent motion of the cloth-fluid mixture within a chamber may be determined. Some of the state parameters that may be measured and recorded include, but are not limited to: position of cloth items, velocity of cloth items, acceleration of cloth items, circulation rate of cloth items, frictional forces between cloth items and chamber surfaces, fluid flow direction, fluid velocity, and fluid acceleration.

In one aspect of the invention, contact sensors can be used to measure the times and locations at which a pre-determined "target cloth" comes in contact with the inner surface of the wash chamber. In one embodiment, the contact sensors are comprised of discrete copper strips laid down on the metallic chamber surfaces with insulating material between the copper strips and the surfaces. The copper strips are supplied a voltage through a pull-up resistor. This strip voltage is referenced to the metallic inner surface of the wash chamber, and is continually monitored. An electrically conductive target cloth is added to the wash chamber, such that when the target cloth contacts the edge of the contact strip, and overlaps the insulator, it provides increased electrical conduction between the strip and the metallic surface. Contact is then detected as a drop in voltage of the strip to a value lower than some threshold voltage that depends on the wash fluid and on the conductivity of the target cloth.

In another aspect of the invention, sensors may be used to measure the rotational position, velocity, and acceleration of various components within the washing machine. In one embodiment, Hall effect sensors are used to measure rotation of the wash basket with respect to the wash bucket, and rotation of the impeller with respect to the wash basket. This information can be combined with the contact sensor data and with video of the top of the wash chamber to calculate the complete target cloth trajectory within the chamber.

In another aspect of the invention, friction sensors may be used to measure the frictional forces between the cloth items and the surfaces within the wash chamber. These surfaces may be on an impeller, agitator, or wash basket, among other surfaces within the chamber. In one embodiment, the friction sensors may be added to a component by cutting a small section of material out of the surface of the component, and reinstalling it very near its original position by mechanically connecting it with a small beam or attachment rod that extends from the cut section to a rigid structure that is part of the component. Two strain gauges mounted on the attachment rod, electrically wired in a half bridge configuration, may be used to measure bending of the rod. This bending can be related to forces tangential to the surface of the sensor (frictional forces) by calibrating the system. Similarly, in another embodiment, the sensor described above as a friction sensor may be used to measure normal forces between the cloth items and the surface by measuring the compressive response of the rod with strain gages wired in a variety of bridge configurations.

In another aspect of the invention, fluid flow direction and velocity may be determined using a tracer fluid injection system. In one embodiment, an output channel of the microcontroller is used to activate a device that injects dye into the chamber via a flush-mounted port in the surface of an interior component. By capturing video during the wash cycle, and knowing the time at which the dye was released, an estimate of fluid flow direction and velocity is determined. In another embodiment, the dye may be replaced with a conductive tracer fluid, and specialized electrical sensors, or the contact sensors themselves, can be used to track the motion of the tracer fluid, which will flow predominantly along with the main wash fluid.

In another aspect of the invention, any signals measured by any of the aforementioned sensors or by any other sensors may be communicated out of the washing machine and into an external data acquisition and control computer. These signals may be communicated using mechanical contacts such as a slip ring, or by using wireless technology. Two-way communication between the data acquisition and control computer and the machine will permit the data acquisition and control computer to also control active devices embedded in the machine, such as the dye injectors previously mentioned.

There are a large number of possible types of motions and circulations of cloth items that this invention can measure. Some of the possible motions that can be measured are: toroidal and inverse toroidal rollover of cloth items, azimuthal motion or circulation of cloth items, and oscillations of cloth items (in any direction or coordinate).

DETAILED DESCRIPTION

The present invention comprises a system and method for measuring cloth motion and forces on cloth items within an automatic washing machine chamber, or more generally, within a chamber containing a mixture of cloth items and a fluid. The invention in whole or in part can be used in any type of clothes washing machine.

Overall System

Figure 1:
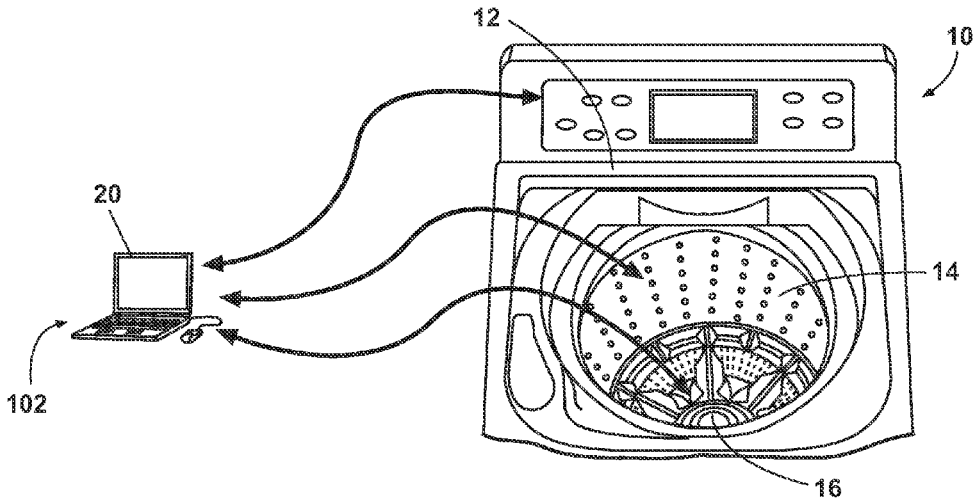
FIG. 1 is a washing machine configured for cloth motion testing embodying the present invention.
Figure 2:
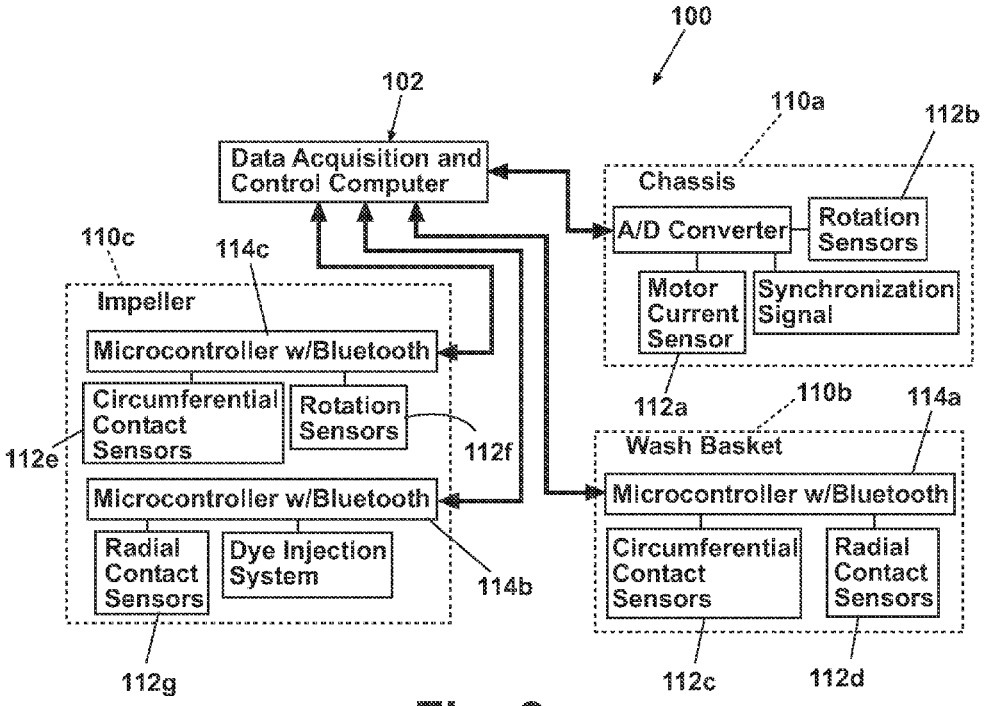
FIG. 2 is a block diagram of an instrumentation system for measuring cloth motion in a washing machine.

A measurement system for measuring cloth motion and forces on cloth items within a washing machine will now be described in detail with initial reference to the illustrative embodiment of the invention as shown in FIGS. 1 and 2. A washing machine 10 is provided having a measurement system 100. A complete measurement system 100 may be constructed that includes a sensing system 110 and a data acquisition and control computer 102. The measurement system 100 may be configured to communicate information from the sensing system 110 to the data acquisition and control computer 102. In one embodiment, shown in FIGS. 1 and 2, sensing systems 110*a*, 110*b*, and 110*c* are installed in a washing machine chassis 12, a wash basket 14, and an impeller 16, respectively, in order to measure cloth motion. The sensing systems 110 may include one or more sensors 112, microcontrollers 114, communication devices, batteries, and antennae. Signals from the sensing systems are communicated to a data acquisition and control computer 20 via a combination of wired and wireless protocol. The data acquisition and control computer 20 is configured to record the signals from the sensing systems, and has the ability to issue commands to the sensing systems in the washer to affect the cloth-cleaning solution mixture in some way, or to effect the washer operation in some way. As one of skill in the art is aware, any number of sensing systems may be provided in order to accomplish various measurements in a washing machine. One or more of the sensing systems may be provided without changing the scope of the invention.

Any necessary electronic equipment may be installed in small spaces or non-intrusive areas such as within towers, impeller blades, or other protrusions. Alternately, it may be possible in some cases to route wiring out of the chamber to small remote computers, or to mechanical contacts that enable communication between the sensors and actuators and the data acquisition and control system.

Figure 3:
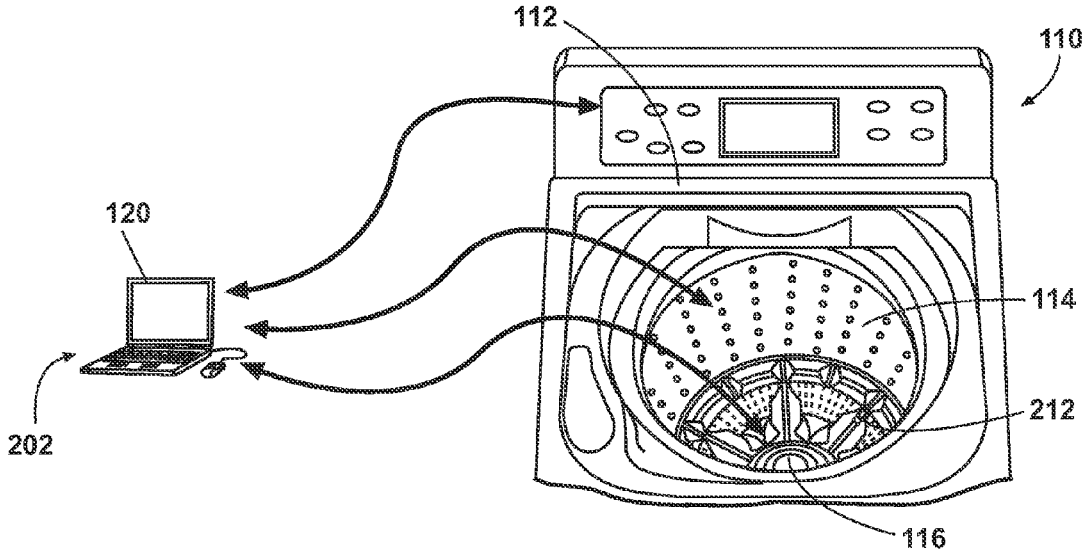
FIG. 3 is a washing machine configured for friction sensing according to a second embodiment of the present invention.
Figure 4:
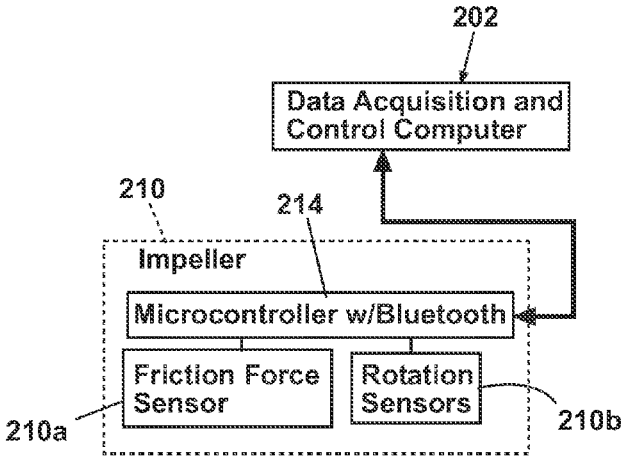
FIG. 4 is a block diagram showing a friction measurement system.

Another embodiment of a complete measurement system is shown in FIGS. 3 and 4. In this embodiment, frictional forces between cloth items and the impeller surface are measured.

Contact Sensors

Figure 5:
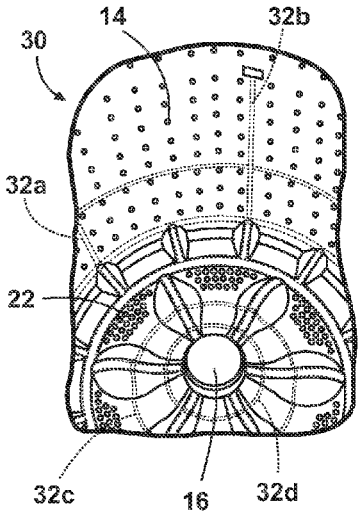
FIG. 5 is an embodiment of contact sensors in a washing machine.
Figure 6:
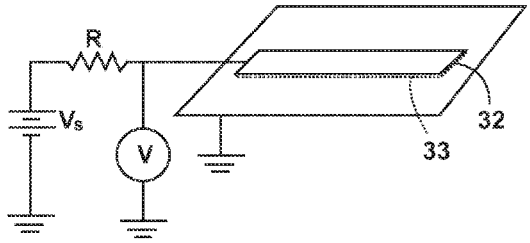
FIG. 6 is an embodiment of a contact sensing circuit using for detecting cloth motion in a washing machine.

Contact sensors can be used to measure the times and locations at which a pre-determined "target cloth" comes in contact with the inner surface of the wash chamber. In one embodiment of a contact measurement system 30, as shown in FIG. 5, the contact sensors are comprised of a plurality of discrete copper strips 32 laid down on the metallic chamber surfaces with insulating material between the copper strips and the chamber surfaces. As shown in FIG. 5, the copper strips 32 may be provided on the inner walls of the wash basket 14 and the floor of the wash basket 22. The copper strips 32 are supplied a voltage Vs through a pull-up resistor R, as shown in FIG. 6. This strip voltage V is referenced to the metallic surface, and is continually monitored. A conductive target cloth is selected, such that when the target cloth contacts the edge of the contact strip 32, and overlaps the insulator, it provides a conduction path between the strip and the metallic surface. Contact is then detected as a drop in voltage, V, of the strip to a value lower than some threshold voltage that depends on the wash fluid and on the conductivity of the target cloth.

A wide range of supply voltages, Vs, may be used. However, very high voltages may lead to corrosion of the contact sensors or of the surfaces of the wash basket, and very low voltages may be more difficult to measure. Low voltages (perhaps down to fractions of a Volt) and higher voltages (perhaps up to tens of Volts) may yield good results. Vs near 5 Volts has been demonstrated to produce a consistently measurable signal while limiting the corrosion rate of copper contact strips to a tolerable level.

Introduction of cleaning solution may cause the contact sensor voltage, V, to drop due to the conductivity of the solution itself. When using Vs=5 V and a 1 kOhm resistor, the cleaning solution may cause the contact sensor voltage to drop as low as 0.3 Volts. Ideally, a target cloth will have much higher conductivity than the cleaning solution, however. Therefore, a threshold voltage of approximately 0.25 Volts may then be used as criteria for detecting "contact" between a target cloth and a contact sensor.

The contact sensors may comprise very thin strips of copper tape 32, preferably having a thickness of about 0.005 inches. The thin strips of copper may be overlying strips of very thin insulating tape 33, preferably having a thickness of about 0.004 inches, for a total sensor height of about 0.009 inches. These sensor heights are small enough to be considered non-intrusive for most testing purposes. In other words, at these heights, they will not significantly change or disturb the natural behavior of the washer. Alternatively, the contact sensors may be dots, patches, grid patterns, or other configurations.

The contact sensors may be arranged in a grid so that the position of the target cloth may be determined in two dimensions. For example, the contact sensors may be arranged circumferentially and radially, at pre-determined intervals of each. Then, an estimate of target cloth position may be obtained using the "last known" radial and circumferential positions.

In using radial contact sensors to estimate the position of a target cloth, the radial contact sensors may be installed on rotating parts. Therefore, their positions may not be constant in time in the inertial frame, and must be adjusted for the amount of rotation they have undergone since the start of the test. This conversion may be accomplished by adding the initial position at the start of the test to the angular position of the given contact sensor at the point of contact. The initial position may be identified by observation or video, while the angular position may be calculated from the rotation sensor signal, as described in the following section.

Once all of the contact occurrences have been identified in space and time, the positions can be plotted versus time to show the trajectory of the target cloth in the wash chamber. If the target cloth is designed to be similar to an ordinary cloth item, this trajectory is one that may be expected for an ordinary cloth item in the machine tested.

In another embodiment of the contact sensors, the cloth items do not need to completely close the circuit between the contact sensor and the metallic surface of the wash chamber or ground. In this embodiment, the contact sensors may electrically sense contact with the target cloth through a variety of methods. One such method would be to use a target cloth that generates an AC signal or periodic voltage that is directly detectable by the contact sensors.

In another aspect of the invention, the target cloth includes a plurality of metallic elements, such as strips, patches, dots, or grids attached thereto and acts as the sensor. The plurality of metallic elements produce identifying electrical signals that are detected by the target cloth and either recorded or transmitted to the outside computer. The identifying electrical signals may be, for example, electrical pulse trains that are distinct for each strip.

Rotation Sensors

Using the measurements of the times and locations at which a target cloth comes into contact with the inner surface of the wash chamber, and knowing the initial positions of the components, the location, velocity, and acceleration of any point on the impeller or wash basket may be estimated at any time during the test. This can be useful for reconstructing the absolute position of any contact indications, allowing the target cloth trajectory to be calculated from the contact sensor and component position data.

Figure 7A:
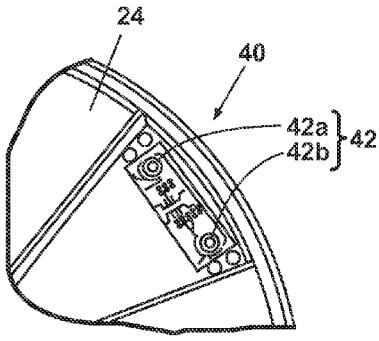
FIG. 7*a* is an embodiment of a rotational measurement system.
Figure 7B:
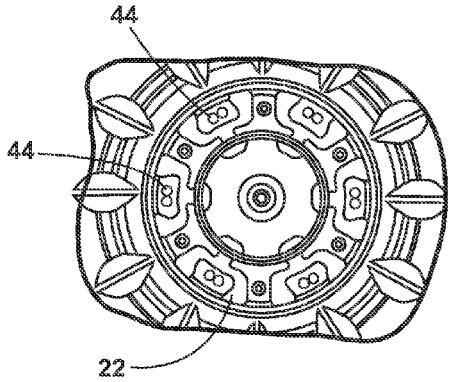
FIG. 7*b* is an embodiment of a rotational measurement system.

One embodiment of a rotation measurement system 40 based on Hall effect sensors 42 is shown in FIGS. 7*a* and 7*b*. It comprises at least two Hall effect sensors spaced by approximately 10 degrees near the perimeter of a rotating component, an impeller in this case. The Hall effect sensors 42 may be placed on the underside of the impeller 16. The Hall effect sensors 42 pass near a plurality of magnets 44 installed in the component for which relative rotation measurement is desired, in this case a wash basket. As shown in FIG. 7*b* (with the impeller removed), the magnets 44 may be arranged in N-S, S-N, N-S, etc. pairs. Thus, as the impeller rotates, the sensors return an alternating +5V and 0V signal as they pass from pair to pair. The rate at which the signal changes is directly related to the angular velocity of the rotating component with respect to the fixed component having magnets. In addition, the direction of rotation may be determined by the leading or lagging of one Hall effect sensor with respect to the next.

Friction Sensors

Figure 8:
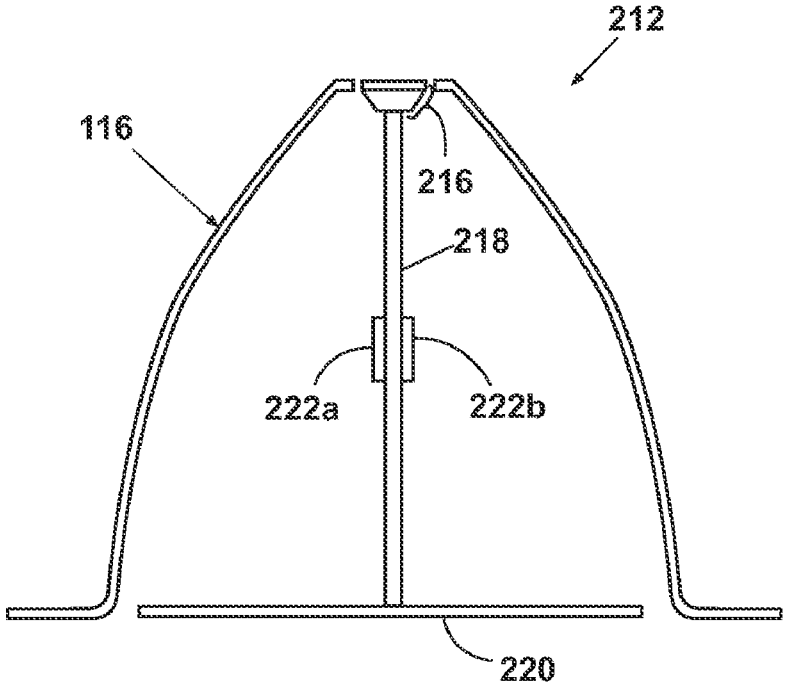
FIG. 8 is an embodiment of a friction measurement system.

Referring again to FIG. 3, a measurement of the frictional forces between the wash chamber 114 and the cloth items may be acquired by an electromechanical friction sensor 212. The friction sensor 212 may be used to measure the friction on any portion of the surface of the wash chamber, provided there is enough empty space below the surface to accommodate the components of the sensor. One embodiment of a friction sensor 212 is shown in FIG. 8. The friction sensor 212 may include a slug 216, which is a portion of the original surface of the wash chamber, a rod 218, a mounting plate 220, and a pair of strain gages 222 wired in a half-bridge circuit. The slug 216 is produced by cutting and removing a portion of the surface of the wash chamber. In previous practice, the diameter of the slug was close to that of an American dime. The slug 216 may be cut from the top surface of an impeller blade used in a washing machine. To cut the slug, it is desirable to use a technique that does not produce burrs or other features that may influence the frictional interaction between the cloth items and the surface of interest. One such technique is electric discharge machining.

Figure 9:
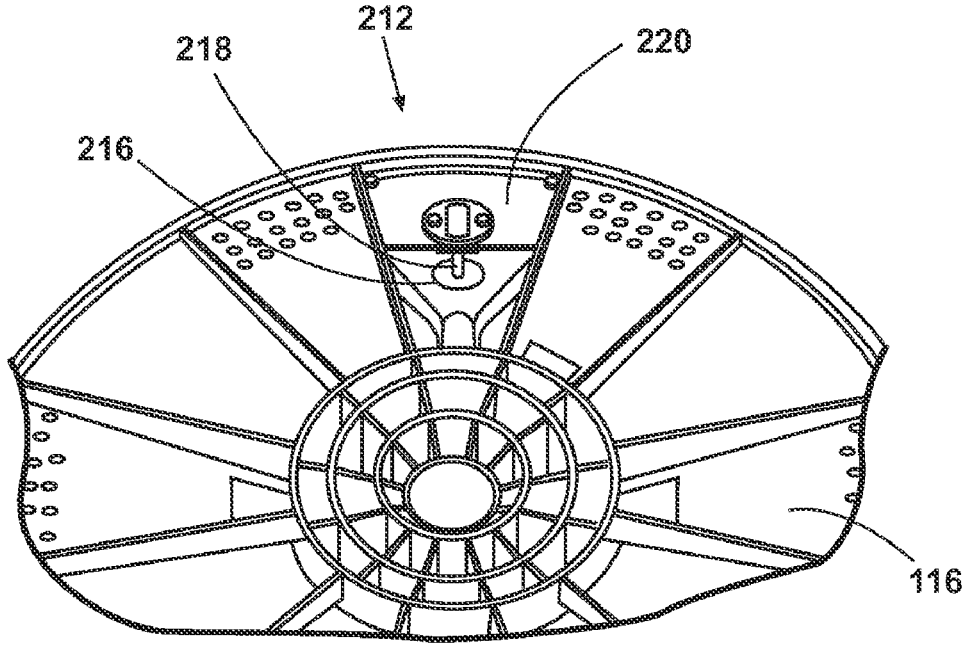
FIG. 9 is the friction measurement system of FIG. 8 mounted in an impeller blade of a washing machine.

In the embodiment of the friction sensor shown in FIG. 8, friction may be measured on the surface of an impeller blade 116 in a washing machine. The slug 216 is mounted on a rod 218 and mounting plate 220 such that the surface of the slug 216 is conformal with the surface from which it was cut. The strain gages 222*a* and 222*b* are mounted on the surface of the rod, coaxial with each other and the rod, and offset 180-degrees from each other along the circumference of the cross-section of the rod. A half-bridge circuit of strain gages produces a non-zero electrical signal only when the two gages detect differing strains. FIG. 9 shows this embodiment from the underside of an impeller instrumented with a friction force sensor. The strain gages are electrically wired in a half-bridge circuit.

Mounting the slug conformal with the surface from which it was cut ensures that the gap between the slug and the surface does not significantly affect the frictional forces to be measured. One undesired effect is that cloth items may engage the machined edge of the slug and produce forces that are unrepresentative of frictional forces applied to the surface of interest. To show that this effect is not present, a series of tests can be executed. In the tests, the machine is operated with cloth items in the wash chamber and the mass of cloth items in the chamber is varied. If the frictional forces scale linearly with the mass of cloth items in the chamber, the forces measured by the sensor are frictional.

A frictional force applied to the surface of the slug 216 causes the rod 218 to deflect in a direction tangential to the surface of the slug 216. If the deflection of the rod 218 has a component parallel to a straight line between the centers of the gages 222, one gage will be compressed and the other gage will be extended. These differing strains produce a non-zero electrical signal, indicating the presence of a frictional force. For a range of forces, the magnitude of the frictional force is linearly proportional to the amount of deflection of the rod 218 and, therefore, to the signal produced by the strain gage circuit.

With the strain gages 222 wired in a half-bridge, a non-zero signal is produced only if the force applied to the surface of the slug 216 has a component parallel to a straight line between the centers of the strain gages. A force coaxial with the long axis of the rod 218, for example, will produce a zero signal because the strain gages will be in equal tension or equal compression. Likewise, a force tangential to the surface of the slug 216 but perpendicular to a straight line between the centers of the strain gages 222 will produce a zero signal because the strain gages will experience equal states of strain. In theory, a force applied to the surface of the slug 216 parallel to but not coaxial with the long axis of the rod 218 would produce a non-zero signal because such a force would produce a moment and consequent bending in the rod 218. However, if the slug 216 is of sufficiently small size, such moments and consequent non-zero signals are negligible.

To measure frictional forces in two perpendicular directions tangential to the surface of the slug 216, an additional pair of strain gages can be mounted offset 90 degrees around the circumference of the cross-section of the rod relative to the first pair of gages and wired in an additional half-bridge circuit.

Figure 10:
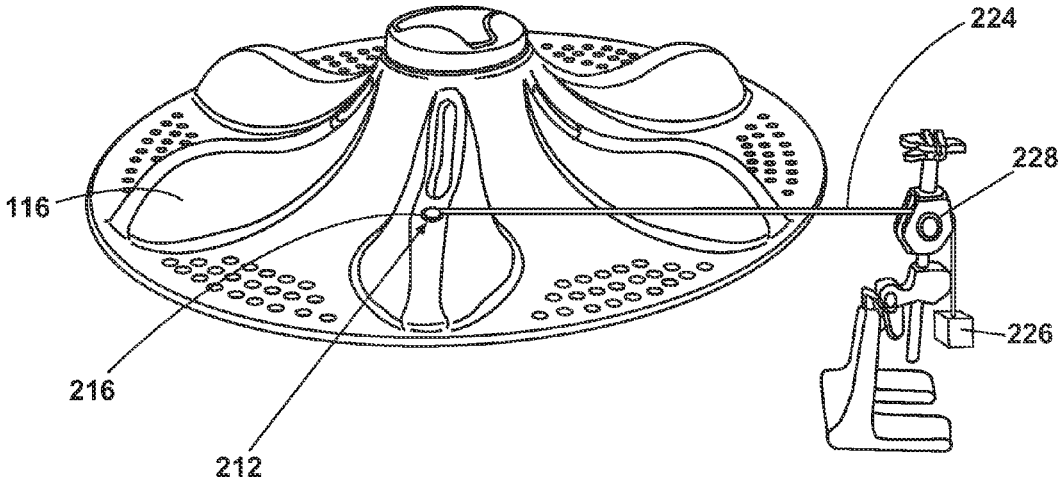
FIG. 10 illustrates a technique for calibrating the friction sensor.

A calibration procedure may be used to quantify the relationship between the magnitude of the electrical signal produced by the strain gage circuit and the magnitude of the frictional force. One such calibration procedure is shown in FIG. 10. As shown, one end of a thin thread 224 is adhered to the surface of the slug 216 with the surface of the slug oriented such that gravity is parallel to the long axis of the rod. An object of known mass 226 is attached to the opposite end of the thread 224. The thread 224 is extended tangential to the surface of the slug 216 and over a lubricated pulley 228 such that the object of known mass 226 hangs freely, applying its weight tangentially to the surface of the slug. By employing a range of known masses, the relationship between the magnitude of the electrical signal and the force applied to the slug can be identified.

The description above is applicable to the measurement of frictional forces, forces acting tangential to the surface of interest. The sensor can also be used to measure forces acting normal to the surface of interest. To accomplish this, four strain gages wired in a full-bridge circuit can be used. Alternatively, two gages in a half-bridge circuit with the gages wired in opposing arms of the bridge, or a single gage in a quarter-bridge circuit, can also be used. None of the other components of the sensor need to be altered from the description above in order to measure forces normal to the surface of interest.

Fluid Flow Sensing System

Figure 11:
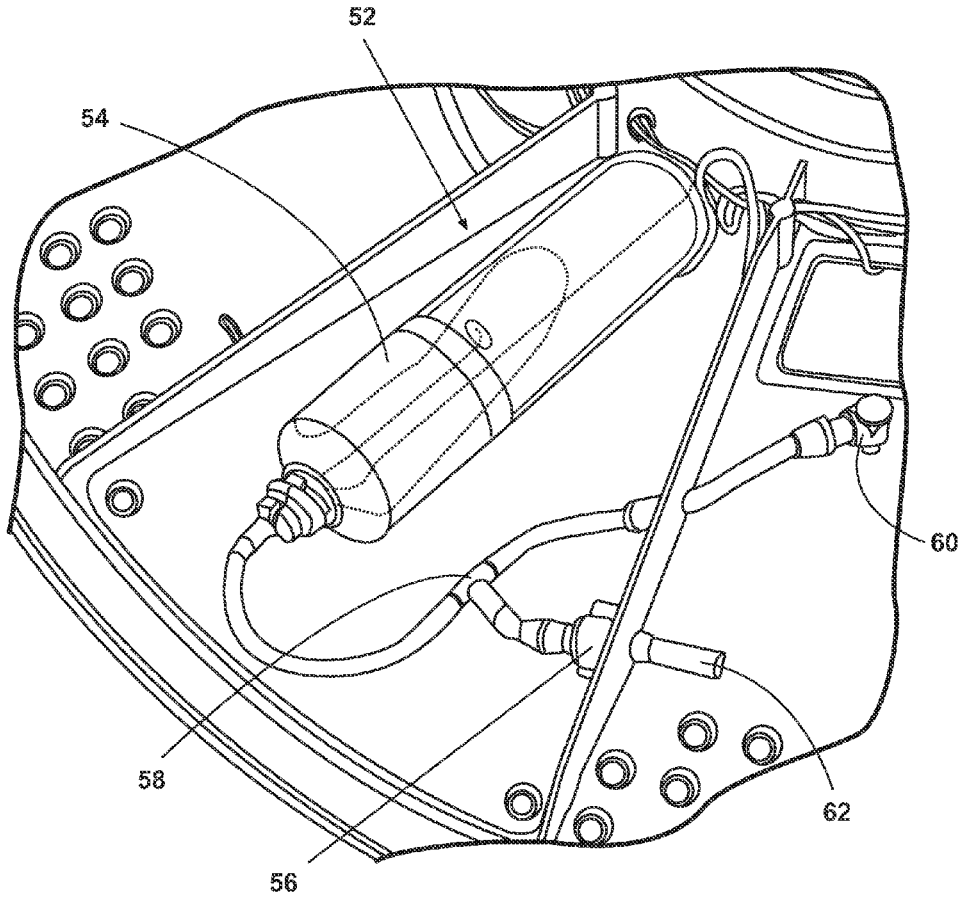
FIG. 11 illustrates an embodiment of a dye injection system.

A fluid flow sensing system 50 may be installed in the washer to determine the direction and velocity of the fluid flow. In one embodiment, as shown in FIG. 11, a dye injection system 52 receives a command from either a microcontroller or an outside computer to inject a fluid into the washer at a specific location. The event may be captured with video. The direction of flow of the fluid may be determined from the video, which can be synchronized with the dye pulse.

In one embodiment, the dye injection system consists of a spring-loaded syringe 54 that can be filled with dye through a check valve 56 via a loading port 62. Once full, the system is loaded and the test begins. A microcontroller receives a signal from an outside computer to inject dye, and then actuates a solenoid valve 58, which allows the dye to quickly flow into the washer from an emission port 60 flush with the wash chamber surface.

In another embodiment, a tracer fluid may be injected either in place of or in conjunction with the dye. This tracer fluid may be a conductive liquid that can be detected by other sensors in the wash chamber, or by monitoring contact sensor voltages. In this embodiment, velocity of the fluid may be determined by measuring the transit time between detection of the conductive fluid by adjacent sensors.

Communication System

In an embodiment of the present invention, microcontrollers may be embedded within the workings of the machine to acquire signals and to control the various sensing systems. The microcontrollers communicate with a computer 20 outside the machine that records the data and commands the smaller electronic units embedded in the machine.

The communication channels between the microcontrollers and the outside computer can be accomplished using a number of technologies. For example, the communication may be via a wireless link, such as Bluetooth. Since the wireless link must transmit and receive the signals through some amount of cleaning solution, relatively high transmit powers must be used. Additionally, antenna matching should be undertaken to ensure the best link possible given the selected transmit power. Commercially available Class 1 Bluetooth transmitters have been found to successfully transmit through the cleaning solution when used with patch antennas also embedded within the washing machine.

Other communication channels that may also work are hard-wire (using slip rings if necessary to communicate between parts with relative concentric rotation), optical links such as IRDA, and many other radio frequencies and protocols.

Buffering of signal data in the microcontrollers may also be used to store data during periods when communication cannot be accomplished. The buffering capacity may range from milliseconds for short link outages to minutes, or even hours for longer link outages. If the buffering is minutes or hours, a complete test may be run, and then the data can be extracted from the buffer. In this case, the microcontrollers act like data loggers, logging the data until the test is complete, at which time it can be communicated to an external computer.

Video

In another aspect of the invention, video may be taken of the top of the washer either through a transparent lid, or with the lid removed and any safety mechanisms deactivated. This video may be synchronized with any electronic data by including, in the view of the video camera, a display showing a running timer that may be correlated to the instrumentation data signals.

The video may be very useful for tracking the target cloth during periods when it is not in contact with the contact sensors, but is visible from the top of the washer. Combining the target cloth position data from the video with target cloth position from the instrumentation data can give a much more detailed representation of the trajectory of the target cloth and the cloth motion in general. The information from the Hall effect sensors, the radial contact sensor data, the circumferential contact sensor data and information from the video, such as the initial location and movement of the impeller and the location of the target cloth when it is on the top of the washer, can be combined to give a three dimensional picture in time of the location of the impeller, target cloth and wash basket.

While the present invention has been described with reference to the above described embodiments, those of skill in the art will recognize that changes may be made thereto without departing from the scope of the invention as set forth in the appended claims.

We claim:

1. A method of determining motion of cloth items in a wash chamber defined by a wash basket having an inner surface, the method comprising the steps of:

fixedly attaching a plurality of contact sensors around the inner surface of the wash chamber;

placing a wash load including an electrically conductive target cloth item in the wash chamber for movement about the wash chamber;

selecting and initiating a wash cycle; and determining a trajectory of the target cloth in two dimensions within the wash chamber by detecting over time contact between the plurality of contact sensors and the target cloth during operation of the wash cycle.

2. The method of claim 1, further comprising the step of applying a voltage to each of the plurality of contact sensors such that contact with the target cloth item is detected as a change in voltage of the plurality of contact sensors.

3. The method of claim 2, wherein the voltage of the plurality or contact sensors changes by an amount exceeding a threshold voltage that depends on one or more of the following: the wash fluid, conductivity of the target cloth, size of the plurality of contact sensors, amount of corrosion on the plurality of contact sensors, material make-up of the plurality of contact sensors, supply voltage and resistor value.

4. The method of claim 1, further comprising the step of insulating the plurality of contact sensors from the wash chamber and configuring the plurality of contact sensors to detect low electrical impedance between the plurality of contact sensors and the wash chamber.

5. The method of claim 1, further comprising the step of configuring the plurality of contact sensors to detect electrical impedance between the plurality of contact sensors and the wash chamber that is lower than background impedance due to contact with detergent solution and non-conductive cloth items in the same wash load.

6. The method of claim 1, further comprising the step of configuring the plurality of contact sensors to detect an alternating current or voltage emitted by the target cloth.

7. The method according to claim 1, further comprising the step of determining whether the target cloth item moves in a toroidal or inverse toroidal cloth motion.

8. A method of determining motion of cloth items in a wash chamber defined by a wash basket having an inner surface, the method comprising the steps of:

moving an electrically conductive target cloth within the wash chamber as part of the operation of a wash cycle;

repeatedly determining the two-dimensional position of the target cloth within the wash chamber based on contact between the target cloth and a plurality of contact sensors spatially arranged about the inner surface; and determining a trajectory of the clothes items based on the repeated determination of the target cloth position.

9. The method of claim 8, wherein the determining the two-dimensional target cloth position comprises repeatedly determining the electrical impedance of the plurality of contact sensors when contacted by the target cloth.

10. The method of claim 8, wherein the determining the two-dimensional target cloth position comprises repeatedly determining change in voltage of the plurality of contact sensors when contacted by the target cloth.

11. The method of claim 10, wherein the voltage of the plurality of contact sensors changes by an amount exceeding a threshold voltage that depends on one or more of the following: the wash fluid, conductivity of the target cloth, size of the plurality of contact, sensors, amount of corrosion on the plurality of contact sensors, material make-up of the plurality of contact sensors, supply voltage and resistor value.

12. The method of claim 8, wherein the determining the two-dimensional target cloth position comprises determining the electrical impedance between the wash chamber and the plurality of contact sensors electrically insulated from the wash chamber.

13. The method of claim 8, wherein the determining the two-dimensional target cloth position comprises determining the electrical impedance between the wash chamber and the plurality of contact sensors, the electrical impedance being lower than background impedance due to contact with detergent solution and non-conductive cloth.

14. The method of claim 8, wherein the determining the two-dimensional target cloth position comprises further comprising detecting an alternating current or voltage emitted by the target cloth.

15. The method according to claim 8, further determining whether the target cloth item moves in a toroidal or inverse toroidal cloth motion.

* * * * *